United States Patent [19]

Norimatsu et al.

[11] 4,178,884

[45] Dec. 18, 1979

[54] METHOD AND SYSTEM TO CONTROL THE MIXTURE AIR-TO-FUEL RATIO

[75] Inventors: Hideaki Norimatsu; Akio Kobayashi; Akira Masuda; Sigenori Kitajima, all of Kariya, Japan

[73] Assignee: Nippondenso Co., Ltd., Kariya, Japan

[21] Appl. No.: 900,505

[22] Filed: Apr. 27, 1978

Related U.S. Application Data

[63] Continuation of Ser. No. 688,390, May 20, 1976, abandoned.

[30] Foreign Application Priority Data

| | | | |
|---|---|---|---|
| Jun. 5, 1975 | [JP] | Japan | 50-683201 |
| Jun. 19, 1975 | [JP] | Japan | 50-70295 |
| Jul. 23, 1975 | [JP] | Japan | 50-89857 |

[51] Int. Cl.[2] ..... F02B 3/00; F02M 7/00

[52] U.S. Cl. ..... 123/32 EE; 123/119 EC

[58] Field of Search ..... 123/119 EC, 32 EE; 60/276, 285

[56] References Cited

U.S. PATENT DOCUMENTS

| | | | |
|---|---|---|---|
| 3,759,232 | 9/1973 | Wahl | 123/32 EE |
| 3,782,347 | 1/1974 | Schmidt | 123/32 EE |
| 3,900,012 | 8/1975 | Wahl | 123/32 EE |
| 3,903,853 | 9/1975 | Kizler | 123/32 EE |
| 3,916,848 | 11/1975 | Schmidt | 123/32 EE |
| 4,019,470 | 4/1977 | Asano | 123/32 EE |

OTHER PUBLICATIONS

"Electronic Closed Loop Controls for Automobiles", John F. Cassidy, Jr., from Automotive Electronics, 2/74.

*Primary Examiner*—Ronald B. Cox

*Attorney, Agent, or Firm*—Cushman, Darby & Cushman

[57] ABSTRACT

A closed-loop air-to-fuel ratio control system having an oxygen responsive sensor and a feedback circuit. The sensor is disposed in an exhaust passage to produce a voltage indicative of the oxygen concentration in the exhaust gas. This voltage is integrated in the feedback circuit with the integration constant predetermined to vary with respect to the time. Air-to-fuel ratio of the mixture to be supplied to the engine is corrected to the predetermined air-to-fuel ratio in response to the integrated voltage. With the integration constant decreasing with respect to the time, the air-to-fuel ratio is speedily returned to the predetermined ratio.

10 Claims, 12 Drawing Figures

12''
13''
14''
18
19
GND
$V_B$
$V_S$
A''
B''
C''
D''
E''
S
$S_1$
$S_2$
$S_0$
$Q_1$
$Q_2$
$Q_3$
$Q_4$
$Q_5$
$Tr_5$
$Tr_6$
9
15
16
17
τ

METHOD AND SYSTEM TO CONTROL THE MIXTURE AIR-TO-FUEL RATIO

This is a continuation of application Ser. No. 688,390 now abandoned filed May 20, 1976.

BACKGROUND OF THE INVENTION (1) Field of the Invention

The present invention relates to an air-to-fuel ratio control system for an internal combustion engine, and, more particularly, to a system wherein the air-to-fuel ratio of the mixture is speedily returned to the predetermined ratio in response to an oxygen concentration in the exhaust gas.

(2) Description of the Prior Art

A closed-loop air-to-fuel ratio control system have been highly appreciated for purifying exhaust gases emitted from the internal combustion engine. Some of these techniques are disclosed in the patents U.S. Pat. No. 3,815,561 and U.S. Pat No. 3,874,171. In these techniques an oxygen responsive sensor disposed in an exhaust pipe and a feedback circuit connected thereto are employed to control either air amount or fuel amount of the mixture in response to the oxygen concentration in the exhaust gas. And it is a well-known art to integrate with the predetermined integration constant, a sensor output voltage which is shown in (A) of FIG. 1 and indicative of the oxygen existence (air-to-fuel ratio) and obtain an integrated voltage for controlling the air-to-fuel ratio in accordance therewith. Due to this control, the air-to-fuel ratio of the mixture to be supplied to the engine changes as shown in (B) of FIG. 1. This Figure depicts a limit cycle trajectory which results from the time delay during which the mixture is converted to the exhaust gas through combustion in the engine. This time delay results in the feedback delay of the system. The time delay is denoted in (B) of FIG. 1 as the time $T_1$ and $T_2$ in which the mixture is controlled to return to the stoichiometric ratio ($\lambda=1$) from the least ratio (the richest ratio) and the greatest ratio (the leanest ratio), respectively. To precisely control the air-to-fuel ratio of the mixture to the stoichiometric ratio, the feedback delay is desired to be short.

SUMMARY OF THE INVENTION

It is therefore, a primary object of the invention to shorten feedback delay time.

It is another object of the invention to vary the integration constant with respect to the time lapse.

It is a further object of the invention to vary the integration constant by charging and discharging a capacitor.

It is a still further object of the invention to vary the integration constant by differentiating the oxygen sensor output voltage.

It is a still further object of the invention to hold the integration voltage in case of specific engine condition.

DETAILED DESCRIPTION OF THE PREFERRED EMBODIMENT

Figure 1:
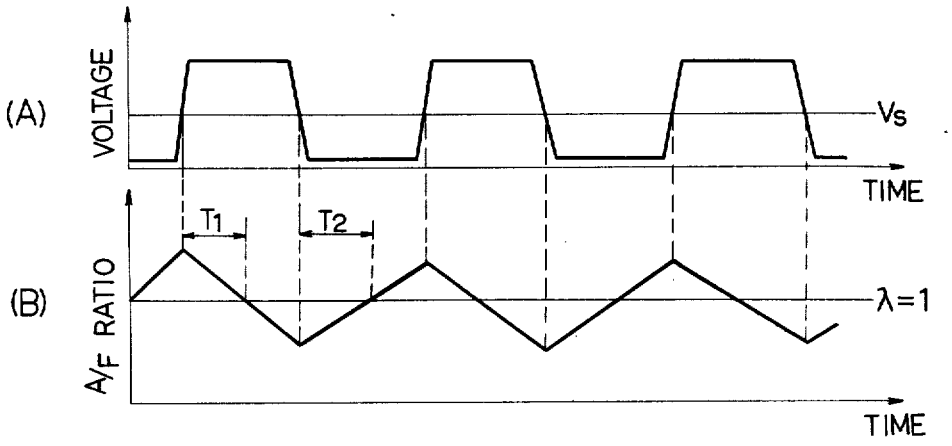
FIG. 1. PRIOR ART
FIG. 1 is a graph showing an output voltage change (A) of an oxygen responsive sensor and a mixture air-to-fuel ratio change (B) according to the prior art system.
Figure 2:
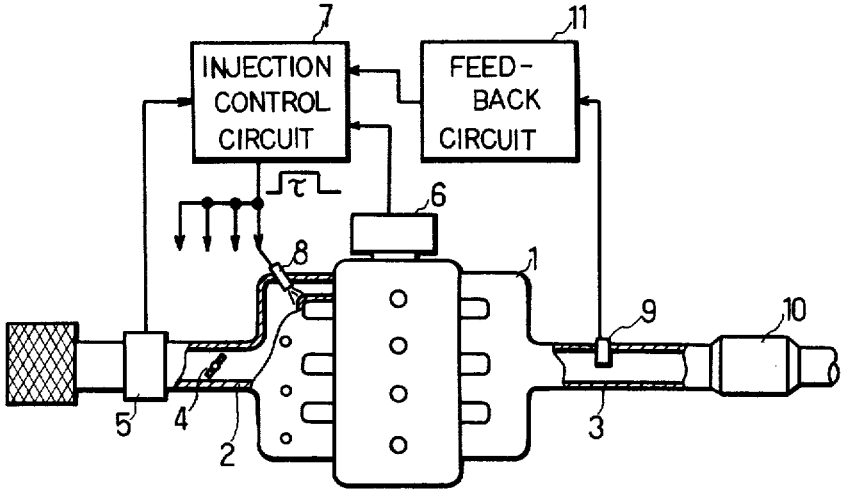
FIG. 2 is a schematic view illustrating a first embodiment of the present invention.

Referring first to FIG. 2, a 4-cylinder internal combustion engine 1 is provided with an intake pipe 2 and an exhaust pipe 3. A throttle valve 4 is pivotally mounted in the intake pipe 2 to control the air amount flowing therethrough. The air flow amount is detected by an air flow sensor 5 disposed upstream of the throttle valve 4. An engine revolution sensor 6 is coupled to the engine 1 to detect the engine rotational speed. The electronic fuel injection control circuit 7 is electrically connected to the sensors 5 and 6 to receive therefrom electric signals indicative of the air flow amount and the rotational speed, respectively. Other sensors for detecting engine operating conditions such as engine coolant temperature and engine cranking may be connected to the injection control circuit 7 as well. The control circuit 7, receiving these electric signals, generates a pulse signal which is to be applied to electromagnetically-operable fuel injectors 8. The pulse duration $\tau$ of the pulse signal is dependent on the electric signals indicative of the operating conditions and determines the fuel amount to be supplied to the engine 1. An oxygen responsive sensor ($O_2$-sensor) 9 is secured to the exhaust pipe 3 for detecting the oxygen concentration in the exhaust gas flowing therethrough and a 3-way catalytic converter 10 is disposed downstream thereof.

Figure 3:
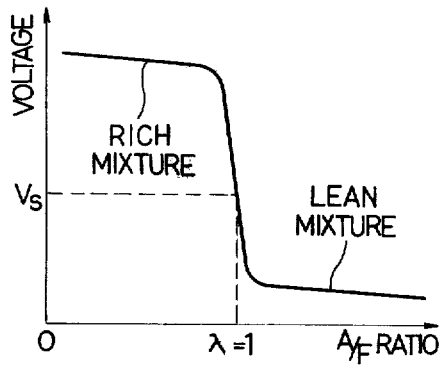
FIG. 3 is a graph showing the output voltage characteristics of the oxygen responsive sensor shown in FIG. 2.
Figure 4:
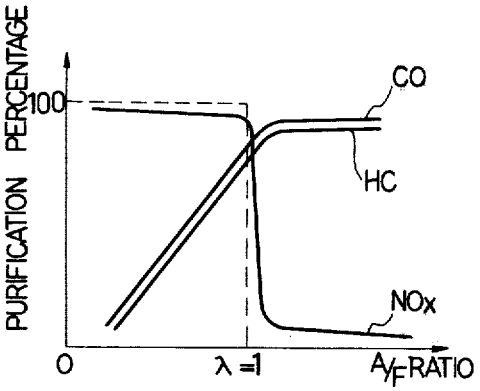
FIG. 4 is a graph showing the exhaust gas purification characteristics of a catalytic converter shown in FIG. 2.

The output voltage characteristics of the $O_2$-sensor 9 are shown in FIG. 3, wherein the abscissa and the ordinate respectively represent the mixture air-to-fuel ratio and the output voltage. The output voltage level of the $O_2$-sensor is, as well known, high and low for the lesser ratio (the richer mixture) and for the greater ratio (the leaner mixture), respectively, and it abruptly changes from one level to the other at the stoichiometric ratio ($\lambda=1$). The purification characteristics of the converter 10 is shown in FIG. 4, wherein the abscissa and the ordinate respectively represent the air-to-fuel ratio and the purification percentage. The purification percentage is very high at the stoichiometric ratio ($\lambda=1$) for all the exhaust gas components, nitrogen oxides ($NO_X$), carbon monoxide (CO) and hydro carbons (HC).

Referring back to FIG. 2, a feedback circuit 11 is connected between the $O_2$-sensor 9 and the control circuit 7 to control the air-to-fuel ratio of the mixture to the stoichiometric ratio around which the exhaust gas purification of the 3-way catalytic converter 10 is excellent. The feedback circuit 11 shortens and lengthens the pulse duration $\tau$ while the high output voltage and the low output voltage are applied from the $O_2$-sensor 9, respectively.

Figure 5:
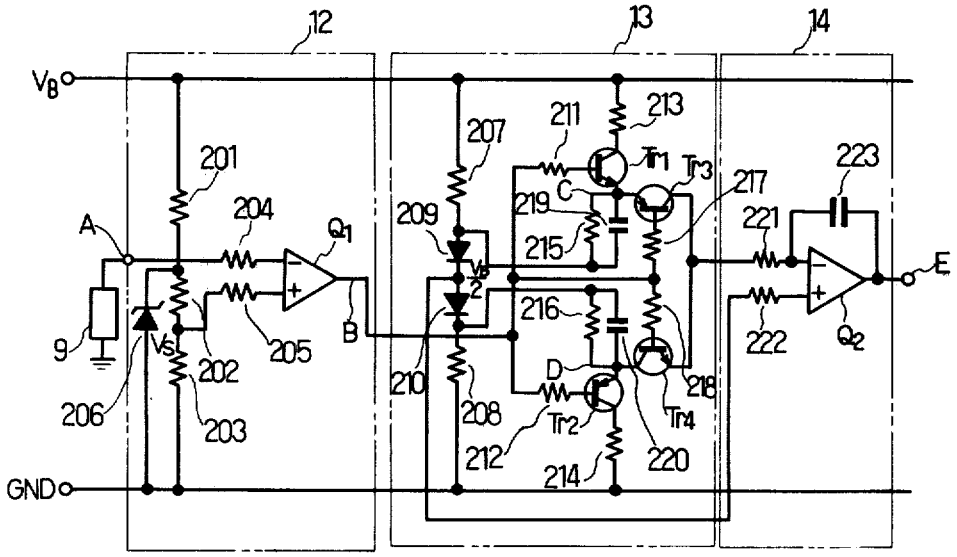
FIG. 5 is an electric wiring diagram of a feedback circuit shown in FIG. 2.
Figure 6:
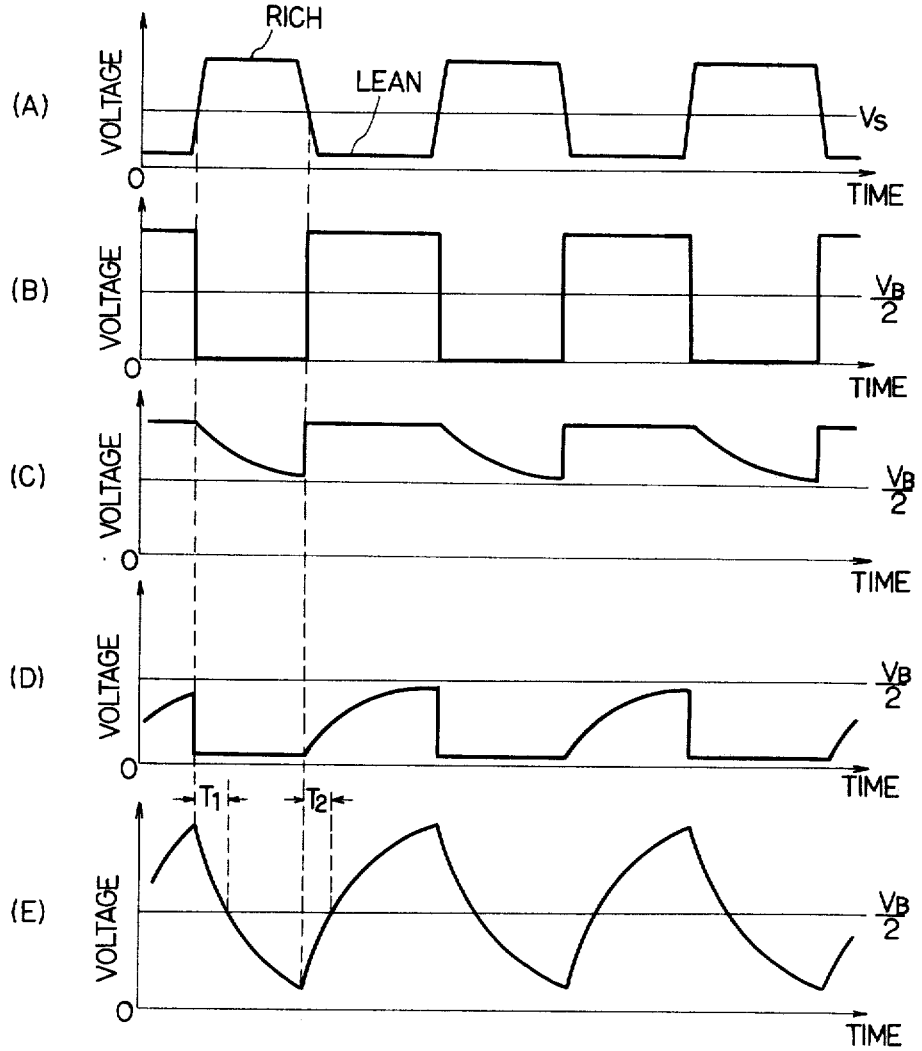
FIG. 6 is a graph showing the voltage waveforms (A) to (E) appearing at respective points A to E in FIG. 5.

The feedback circuit 11 is comprised of a comparison circuit 12, a waveform correction circuit 13 and an integration circuit 14 as shown in FIG. 5. In this figure $V_B$ designates a voltage potential of a battery (not shown) and GND designates the ground potential. The comparison circuit 12, connected to the $O_2$-sensor 9, is constructed with resistors 201 to 205, a zener diode 206 and an operational amplifier $Q_1$. The output voltage of the $O_2$-sensor 9 is applied to the negative terminal (−) of the amplifier $Q_1$ through a terminal A, whereas voltage $V_s$ is applied to the positive terminal (+) of the amplifier $Q_1$. The voltage $V_s$ is regulated to be constant by the resistors 202 and 203 and the zener diode 206 and equal to the $O_2$-sensor output voltage indicative of the stoichiometric ratio of the mixture. The comparison circuit 12 produces at an output terminal B a high level voltage while the $O_2$-sensor output voltage is lower than the set voltage $V_s$, whereas it produces a low level voltage while the former is higher than the latter. In FIG. 6 the output voltage change of the comparison circuit 12 at the terminal B is shown in (B) with respect to the output voltage change (A) of the $O_2$-sensor 9 at the terminal A.

The waveform correction circuit 13 is constructed with resistors 207, 208 and 211 to 218, diodes 209 and 210, capacitors 219 and 220 and transistors Tr1 to Tr4. The resistors 207 and 208 are respectively connected to the $V_B$ line and the GND line, and the diodes 209 and 210 are connected in series between the resistors 207 and 208. The voltage potential at the junction between the diodes 209 and 210 is predetermined to be $V_B/2$, a half of the battery voltage. The resistor 213, the collector-emitter path of the transistor Tr1 and the capacitor 219 are connected in series between the $V_B$ line and the junction of the resistor 207 and the diode 209. The resistor 215 is connected in parallel to the capacitor 219. On the other hand the resistor 214, the collector-emitter path of the transistor Tr2 and the capacitor 220 are connected in series between the GND line and the junction of the resistor 208 and the diode 210. The resistor 216 is connected in parallel to the capacitor 220. The bases of the transistors Tr1 and Tr2 are connected in common to the output terminal B of the comparison circuit 13 through respective resistors 211 and 212. The emitter of the transistor Tr3 is connected to the emitter of the transistor Tr1 and the collector of the transistor Tr4 is connected to the emitter of the transistor Tr2. The bases of the transistors Tr3 and Tr4 are also connected in common to the output terminal B of the comparison circuit 12 through respective resistors 211 and 218.

With the high level voltage developing at the terminal B the transistors Tr1 and Tr4 are rendered conductive, whereas the transistors Tr2 and Tr3 are nonconductive. During this condition the capacitor 219 is charged through the transistor Tr1 and the voltage potential at the junction C remains constant as shown in (C) of FIG. 6, whereas the capacitor 220 is discharged through the transistor Tr4 and the voltage potential at the junction D increases as shown in (D) of FIG. 6. The voltage potential increasing rate is dependent on the time constant determined by the resistor 216 and the capacitor 220. On the other hand, on-off conditions of the transistors Tr1 to Tr4 are reversed when the low level voltage develops at the terminal B. During this condition the charged capacitor 219 is discharged through the transistor Tr3 which is in the conduction state, whereas the discharged capacitor 220 is charged through the transistor Tr2 which is in the conduction state. The voltage potentials at the junction C and D are shown in (C) and (D ) of FIG. 6, respectively. The potential decreasing rate at the junction C is dependent on the time constant determined by the resistor 215 and the capacitor 219. The voltage potential changing rate at the junctions C and D becomes less as the time passes.

The integration circuit 14 is constructed with resistors 221 and 222, a capacitor 223 and an operational amplifier $Q_2$. The negative terminal (−) of the amplifier $Q_2$ is connected through the resistor 221 to the junction between the collector of the transistor Tr3 and the emitter of the transistor Tr4, whereas the positive terminal (+) thereof is connected through the resistor 222 to the junction between the diodes 209 and 210. The capacitor 223 is connected between the input terminal (−) and the output terminal of the amplifier $Q_2$.

The discharging current of the capacitors 219 and 220 are applied to the integration circuit 14 through the transistors Tr3 and Tr4 and integrated therein. As the transistors Tr3 and Tr4 are rendered conductive by turns, the output voltage which develops at a terminal E of the integration circuit 14 changes positively and negatively as shown in (E) of FIG. 6. The increase and the decrease of the voltage potential at the terminal E respectively lasts during the conduction of the transistors Tr4 and Tr3, and the voltage changing rate decreases as the time passes. It will be understood that correcting the waveform of the comparison-resultant voltage in the circuit 13 is equivalent to changing the integration constant of the integration circuit 14.

The integration-resultant voltage is then applied to the above electronic fuel injection control circuit 7 to correct the pulse duration $\tau$ of the pulse signal. The duration $\tau$ is lengthened while the integration voltage is higher than the constant voltage $V_B/2$, whereas it is shortened while the former is lower than the latter. Correction rate of the duration $\tau$ is proportional to the voltage difference between the integration voltage and the constant voltage $V_B/2$. As a result, the air-to-fuel ratio of the mixture is controlled in accordance with the integration voltage, and the air-to-fuel ratio change with respect to the time can be represented by the integration voltage change shown in (E) of FIG. 6 provided that the ordinate and the straight line $V_B/2$ thereof are regarded as the air-to-fuel ratio and the stoichiometric ratio. According to the above embodiment, the air-to-fuel ratio change depicts a limit cycle trajectory and the feedback delay time $T_1$ and $T_2$ are shortened resulting in that the air-to-fuel ratio apart from the stoichiometric ratio can be speedily returned to the stoichiometric ratio. The delay times $T_1$ and $T_2$ are controlled to be less than one half of the time during which $O_2$-sensor voltage remains constant.

Figure 7:
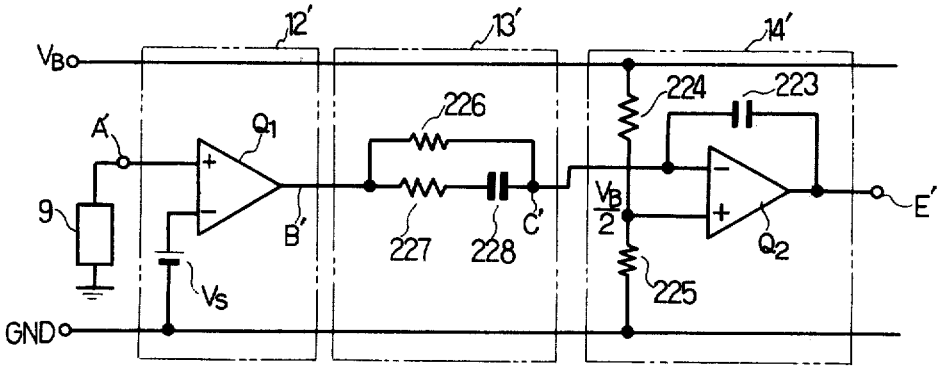
FIG. 7 is an electric wiring diagram of a feedback circuit according to the second embodiment.
Figure 8:
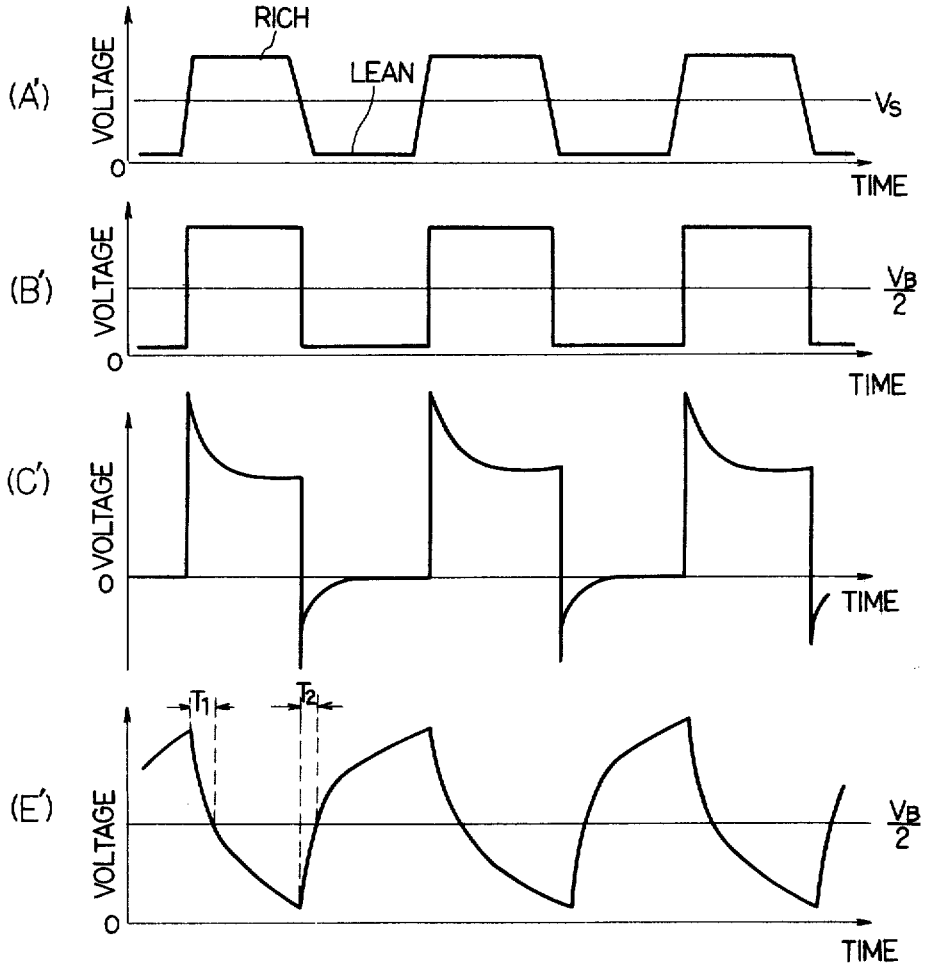
FIG. 8 is a graph showing voltage waveforms (A'), (B'), (C') and (E') appearing at respective points A', B', C' and E' in FIG. 7.

Second embodiment of the present invention is described hereinunder with reference to FIG. 7, wherein the circuit construction of only the feedback circuit is shown. The comparison circuit 12' is connected to the $O_2$-sensor 9 and is provided with the operational amplifier $Q_1$ which receives the sensor output voltage and the set voltage $V_s$ at the positive terminal (+) and the negative terminal (−), respectively. In this circuit 12' the sensor output voltage appearing at a terminal A' and shown in (A') of FIG. 8 is compared with the set voltage $V_s$ indicative of the stoichiometric ratio and a rectangular output voltage shown in (B') of FIG. 8 is produced at a terminal B'.

The comparison circuit 12' is connected to the waveform correction circuit 13', wherein a resistor 226 is coupled in parallel to a series connection of a resistor 227 and a capacitor 228 constituting a differentiation circuit. In this circuit 13' the output voltage from the comparison circuit 12' is passed through the resistor 226 whereas it is differentiated by the capacitor 228. Voltages from the resistor 226 and the capacitor 228 are added as shown in (C') of FIG. 8 at a junction C'. This voltage level is high and low when the comparison-resultant voltage is high and low, respectively. Besides, the voltage changing rate in each level is dependent on the time lapse due to the above differentiating operation. The changing rate decreases as the time passes.

The waveform correction circuit 13' is connected to the integration circuit 14', wherein resistors 224 and 225 are connected in series across the $V_B$ line and the GND line and the operational amplifier $Q_2$ and the capacitor 223 are provided. The negative terminal (−) and the positive terminal (+) of the amplifier $Q_2$ are connected to the junction C' of the correction circuit 13' and the junction between the resistors 224 and 225, respectively. The series-connected resistors 224 and 225 provides the set voltage $V_B/2$. The integration circuit 14' integrates the current which is dependent on the voltage potential at the junction C' and produces the output voltage shown in (E') of FIG. 8 at a terminal E'. This output voltage alternately increases and decreases in response to the output voltage of the correction circuit 13' and the changing ratio in each direction thereof decreases in accordance with the time lapse. This integrating operation with time-dependent integration constant results in the shorter time periods $T_1$ and $T_2$ in which the integration-resultant voltage returns to the set voltage $V_B/2$ from the highest and the lowest, respectively. The output voltage at the terminal E' is applied to the injection control circuit 7 and the fuel injection amount is corrected therein in the same manner as described in the first embodiment. As a result the feedback delay time which is equal to the above time periods $T_1$ and $T_2$ is shortened enough to better the response delay of the system.

Figure 9:
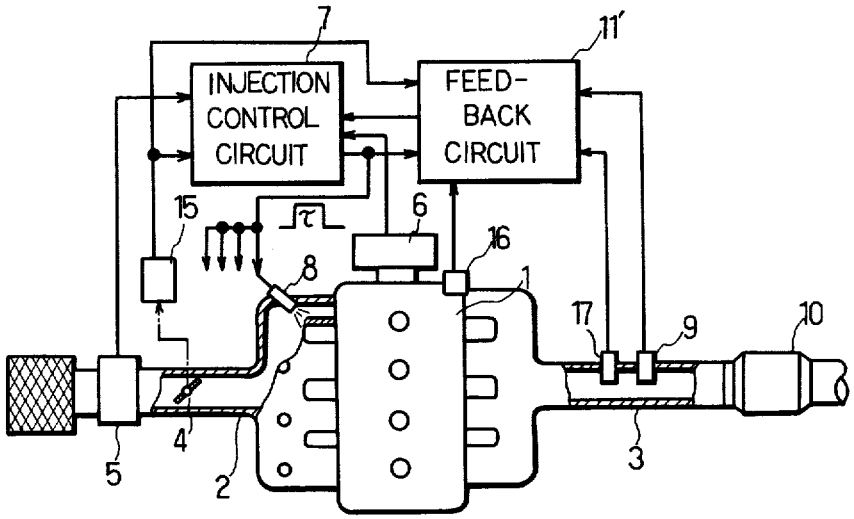
FIG. 9 is a schematic view illustrating a third embodiment of the present invention.

Third embodiment of the present invention is described hereinunder with reference to FIGS. 9 to 12. In FIG. 9, a throttle position sensor 15 coupled to the throttle valve 4 for detecting the closed position thereof, a coolant temperature sensor 16 secured to the engine 1 for detecting the engine coolant temperature and a gas temperature sensor 17 disposed in the exhaust pipe 3 for detecting the exhaust gas temperature are electrically connected to the feedback circuit 11' to provide each electric signals thereto. The injection control circuit 7 is connected to the feedback circuit 11' to provide the pulse signal thereto. Other component parts bearing the same reference numerals 1 to 10 are quite same as in the first embodiment shown in FIG. 2.

Figure 10:
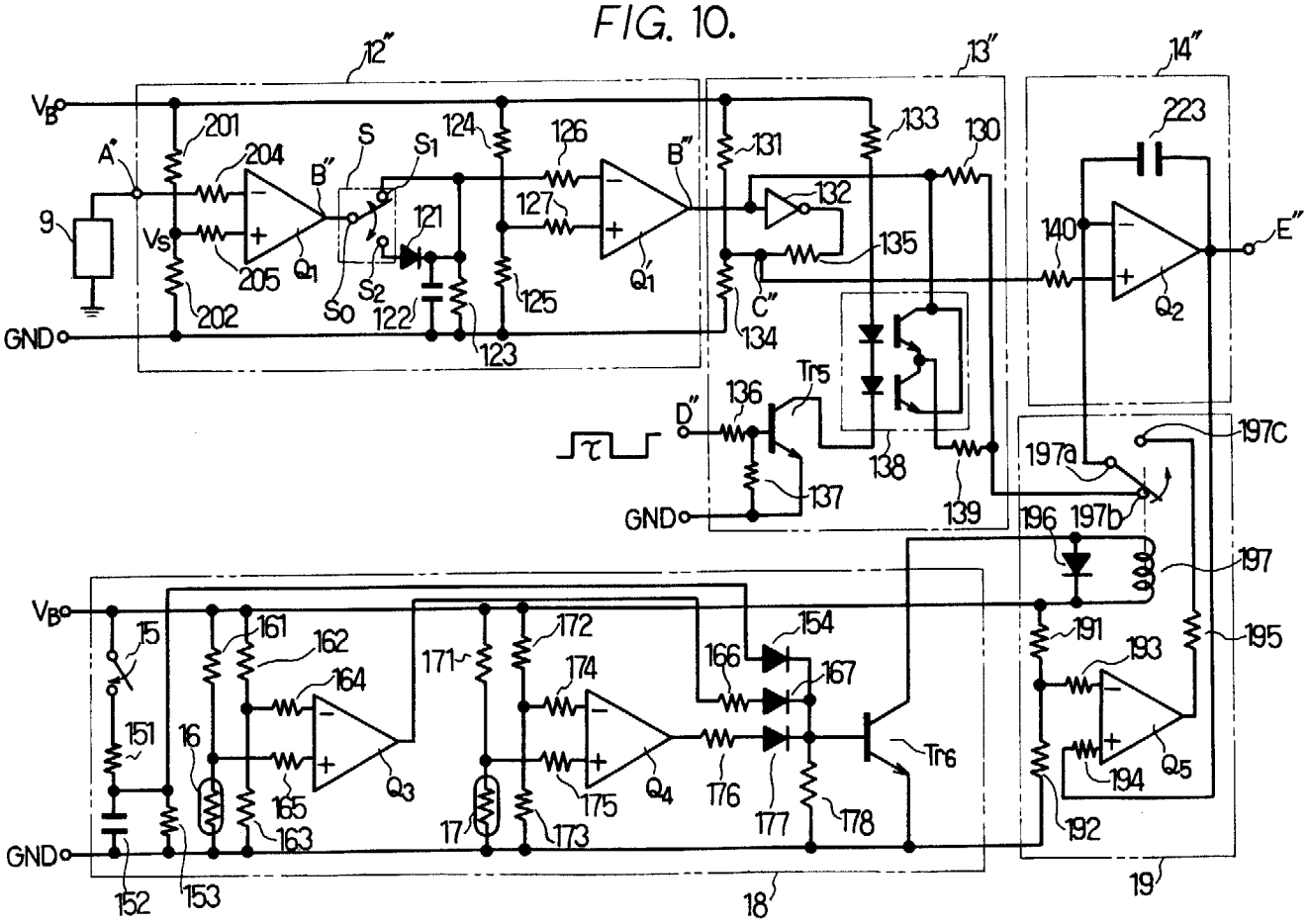
FIG. 10 is an electric wiring diagram of a feedback circuit shown in FIG. 9.
Figure 12:
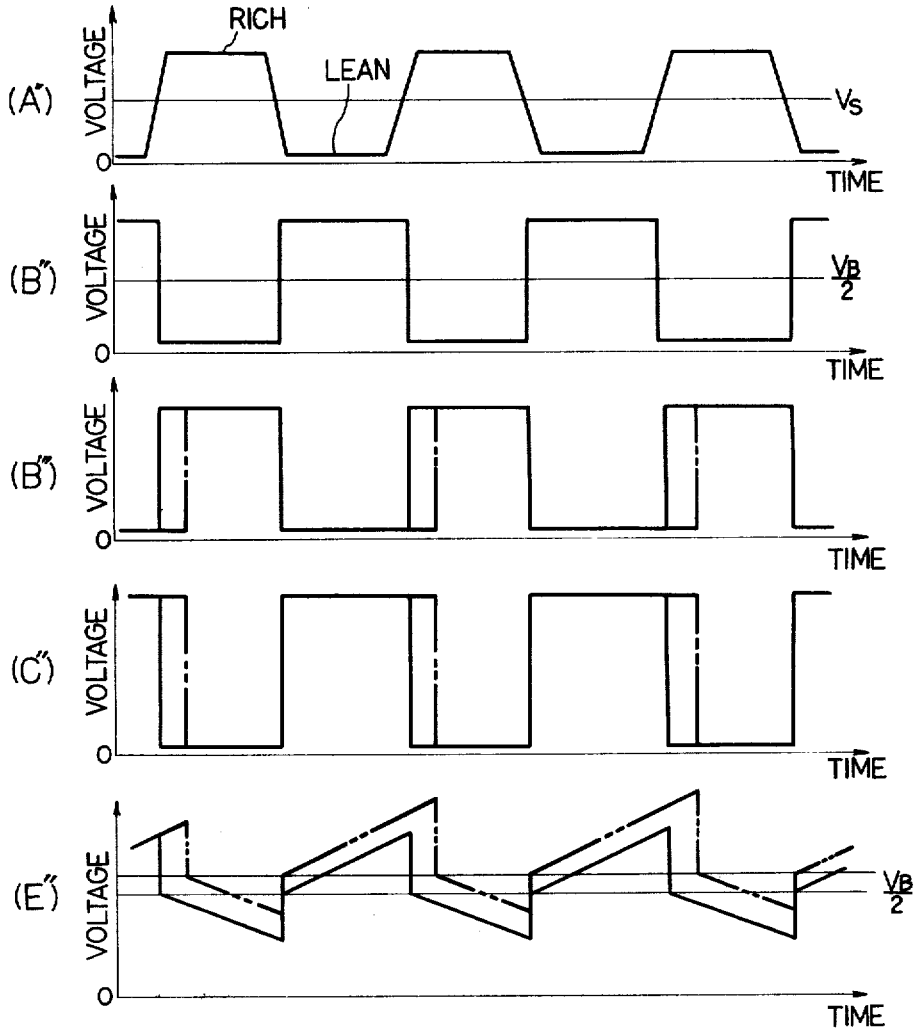
FIG. 12 is a graph showing the voltage waveforms (A'') to (E'') appearing at the respective points (A'') to (E'') in FIG. 10.

Detail circuit construction of the feedback circuit 11' is shown in FIG. 10, wherein a discrimination circuit 18 for discriminating the engine operating conditions and an integration hold circuit 19 for prohibiting the integration circuit 14" from the integration operation are also shown. The comparison circuit 12" connected to the $O_2$-sensor 9 is formed with resistors 201, 202, 204, 205, 123, 124, 125, 126, and 127, operational amplifiers $Q_1$ and $Q_1'$, a selection switch S, a diode 121 and a capacitor 125. The sensor output voltage appearing at a terminal A" and shown in (A") of FIG. 12 is compared with the set voltage $V_s$ by the amplifier $Q_1$, resulting in the rectangular voltage shown in (B") of FIG. 12 at a terminal B". The rectangular voltage at the terminal B" is inverted by the amplifier $Q_1'$ when the contact points $S_0$ and $S_1$ of the selection switch S are in contact, whereas it is first delayed by the parallel connection of the capacitor 122 and the resistor 123 and inverted by the amplifier $Q_1'$ thereafter when the contact points $S_0$ and $S_2$ are in contact. The inverted voltages appearing at a terminal B''' are shown in (B''') of FIG. 12, wherein the two-chain dotted line waveform attributes to the voltage transmission delay caused by the capacitor 122 and the resistor 123.

Figure 11:
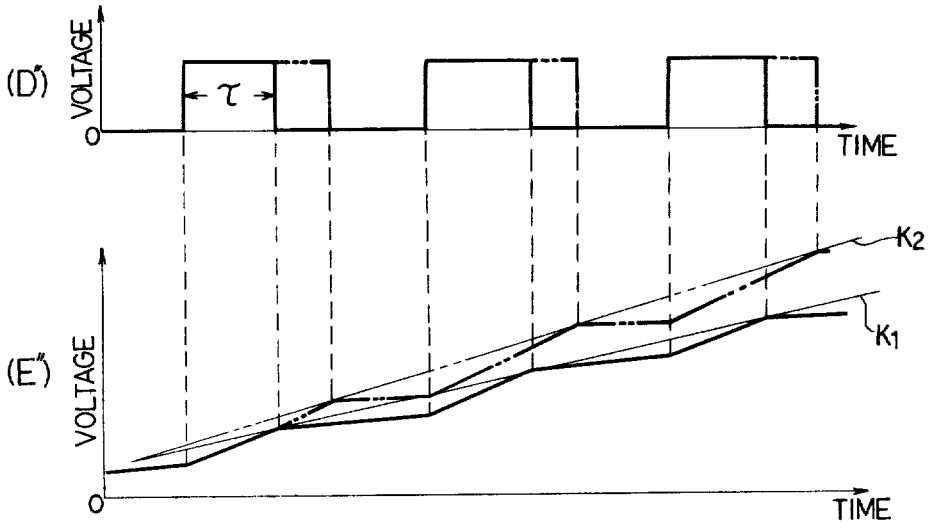
FIG. 11 is a graph showing the voltage waveforms (D'') and (E'') appearing at the respective points D'' and E'' in FIG. 10.

The waveform correction circuit 13" is constituted with resistors 130, 131, 133, 134, 135, 136, 137 and 139, an inverter 132, a photo-coupler 138 and a transistor Tr5 and the integration circuit 14" is formed with a resistor 140, a capacitor 223 and the amplifier $Q_2$. An input terminal D" of the correction circuit 13" is electrically coupled to the fuel injection control circuit 7 of FIG. 7 to be supplied with the injection pulse signal having the pulse duration $\tau$. During the presence and the absence of the pulse signal at the terminal D" the transistor Tr5 and the photo-coupler 138 are rendered conductive and nonconductive, respectively. The resistance value between the output terminal B''' of the comparison circuit 12" and the negative input terminal (−) of the integration circuit 14" is greater when the photo-coupler 138 is in the conductive state than when it is in the nonconductive state. The integration-resultant voltage appearing at a terminal E" eventually changes with the greater changing ratio when the pulse signal is applied to the terminal D". The pulse signal at the terminal D" and the integration-resultant voltage at the terminal E" are shown in (D") and (E") of FIG. 11, respectively, assuming that the voltage level at the terminal B''' is low. FIG. 11 shows that the changing rate of the integration-resultant voltage in the increasing direction is greater during the presence of the pulse signal than during the absence thereof, and that the average changing rates $K_1$ and $K_2$ resulting from the respective short and long pulse duration is in the proportional relationship with the pulse duration $\tau$.

The integration-resultant voltage at the terminal E" further changes in the increasing and decreasing directions in response to the low and high voltages at the terminal B''', respectively. As the output voltage at the terminal B''' is inverted by the inverter 132, voltage potential at a junction C" changes as shown in (C") of FIG. 12. Each time the voltage potential at the terminal B''' abruptly changes, not only the nagative input voltage but also the positive input voltage changes to cause the voltage at the terminal E" to abruptly change as shown in (E") of FIG. 12. The voltage changing rate in (E") of FIG. 12 corresponds to the average changing rate such as $K_1$ and $K_2$ described with reference to FIG. 11. The two-chain dotted line waveforms in (C") and (E") of FIG. 12 are derived at the junction C" and the terminal E", respectively, in case that the contact points $S_0$ and $S_2$ of the selection switch are in contact. It should be understood in (E") of FIG. 12 that average voltage levels to which the integration-resultant voltage with the respective solid line and the dotted line is returned differ from to each other. The average voltage level $V_B/2$ of the solid line waveform is lower than that of the dotted line waveform.

Provided that the integration-resultant voltage is so applied to the injection control circuit 7 as in the first and second embodiment, feedback delay time is decreased to zero. Further, the mixture air-to-fuel ratio is controlled to a lower air-to-fuel ratio ($\lambda<1$) with the voltage in dotted line. For this purpose, the selection switch S can be constructed to be responsive to engine operating conditions, for example responsive to the throttle valve 4. To control the air-to-fuel ratio to a higher ratio ($\lambda<1$) contrary to the above described control, the leading edge of the rectangular voltage shown in (B'') of FIG. 12 can be delayed.

In this embodiment, the integration circuit 14'' is prevented from the integration operation by the integration hold circuit 19 which is responsive to the discrimination circuit 18. The discrimination circuit 18 shown in FIG. 10 includes the throttle position sensor 15 which closes when the throttle valve is closed, the engine coolant temperature sensor 16 and the exhaust gas temperature sensor 17.

Thermally sensitive resistors having a negative temperature-coefficient can be applicable to the temperature sensors 16 and 17. The throttle position sensor 15 is connected, across the $V_B$ line and the GND line in series with a resistor 151 and a capacitor 152 to which a resistor 153 is connected in parallel. A high level voltage develops at a junction between the resistor 151 and the capacitor 152 only when the sensor 15 closes. Across the $V_B$ line and the GND line a resistor 161 and the sensor 16 are connected in series and a resistor 162 and a resistor 163 are connected in series. An operational amplifier $Q_3$ is connected to the junction of the resistor 161 and the sensor 16 through a resistor 165 and to the junction of the resistors 162 and 163 through a resistor 164. The amplifier $Q_3$ produces a high level voltage only when the positive input (+) voltage is higher than the predetermined negative input (−) voltage, i.e., only when the engine coolant temperature is lower than the predetermined value. Across the $V_B$ line and the GND line, a resistor 171 and the sensor 17 are connected in series and resistors 172 and 173 are connected in series. An operational amplifier $Q_4$ is connected to the junction of the resistor 171 and the sensor 17 through a resistor 175 and to the junction of the resistors 172 and 173 through a resistor 174. The amplifier $Q_4$ produces a high level output voltage only when the positive input (+) voltage is higher than the negative input (−) voltage, i.e., the exhaust gas temperature is lower than the predetermined value (450° C.~600° C.). Three diodes 154, 167 and 177, being connected respectively to the junction of the resistor 151 and the capacitor 152, to the amplifier $Q_3$ through a resistor 166 and to the amplifier $Q_4$ through a resistor 176, form an OR logic circuit. The diodes 154, 167 and 177 are connected in turn to the base of a transistor Tr6, across the base and the emitter thereof being coupled with a resistor 178, to render the transistor Tr6 conductive each time at least one of the high level voltages is applied thereto. The transistor Tr6, to this end, is rendered conductive on condition that the throttle valve 4 is closed upon engine idling and engine deceleration, the engine coolant temperature is low enough for ruel enrichment, or the exhaust gas temperature is low enough causing the $O_2$-sensor 9 inoperative.

The integration hold circuit 19 is constituted with resistors 191 and 192 connected in series across the $V_B$ line and the GND line, resistors 193 and 194, an operational amplifier $Q_5$ for comparing the voltage at the terminal E'' with the voltage at the junction of the resistors 191 and 192, a resistor 195, a diode 196 and a relay 197 connected to the transistor Tr6 to be controlled thereby. While the transistor Tr6 is in the non-conductive state, the movable contact **197*a* is in contact with the contact 197*b* to allow the above integration operation of the circuit 14''. While the transistor Tr6 is in the conductive state, however, the movable contact 197*a* is forced to contact with the contact 197*c* by the relay 197, causing the output voltage of the amplifier $Q_5$ to be applied through the resistor 195 to the integration circuit 14'' for integration thereof. The integration-resultant voltage at the terminal E'' increases and decreases when the set voltage determined by the resistors 191 and 192 is higher and lower than the integration-resultant voltage, respectively. The integration operation stops when the two voltages becomes equal, resulting in the constant voltage at the terminal E''. This constant voltage is equal to the set voltage determined by the resistors 191 and 192**. The air-to-fuel ratio of the mixture is no longer corrected provided that the integration-resultant voltage at the terminal E'' is thus held to the voltage $V_B/2$. The above integration holding operation is useful in case the feedback control is not desired.

Other embodiments and modifications, such as controlling additional air amount in response to the integration voltage, can be easily made without departing from the scope of this invention.

We claim:

1. An air-to-fuel ratio control system for an internal combustion engine comprising:

a sensor, disposed in the exhaust pipe of an engine, for producing a sensor output signal having a signal level indicative of the air-to-fuel ratio of mixture supplied to said engine;

a comparison circuit, connected to said sensor, for producing a comparison output signal the signal level of which is stepwise changed between two constant levels each time said signal level of said sensor output signal reaches a constant level predetermined with reference to a desired air-to-fuel ratio;

an integration circuit, connected to said comparison circuit, for producing an integration output signal the signal level of which is increased and decreased with the time lapse while said signal level of said comparison output signal is kept at one and the other between said two constant levels, respectively;

a correction circuit, connected between said comparison circuit and said integration circuit, for stepwise correcting said signal level of said integration output signal in synchronism with the level change of said comparison output signal such that said signal level of said integration output signal is abruptly decreased and increased by a predetermined level when the changing direction of said integration output signal is reversed from the increasing to decreasing directions and from the decreasing to increasing directions, respectively; and mixture supply means for supplying said engine with the mixture having an air-to-fuel ratio corrected in accordance with said signal level of said integration output signal.

2. An air-to-fuel ratio control system according to claim 1 further comprising:

detection means for producing a detection output signal while at least one operating parameter of said engine is in a predetermined range; and a hold circuit, connected to said detection means and said integration circuit, for holding said signal level of said integration output signal at a predetermined constant level irrespective of the level change of said comparison output signal while said detection output signal is produced, whereby correcting the air-to-fuel ratio of mixture is prevented.

3. An air-to-fuel ratio control system according to claim 2, wherein said detection means includes:

an engine temperature detector, adapted to detect the temperature of said engine, for producing said detection output signal while said temperature is lower than a predetermined engine temperature.

4. An air-to-fuel ratio control system according to claim 2, wherein said detection means includes:

an exhaust temperature detector, adapted to detect the temperature of exhaust gases flowing through said exhaust pipe, for producing said detection output signal while said temperature is lower than a predetermined exhaust temperature.

5. An air-to-fuel ratio control system according to claim 2, wherein said detection means includes:

a throttle detector, adapted to detect the opening angle of throttle valve of said engine, for producing said detection output signal while said throttle valve is closed.

6. An air-to-fuel ratio control system according to claim 1, wherein said correction circuit includes inverter means for proportionally inverting said signal level of said comparison output signal, and wherein said integration circuit includes:

an amplifier having a non-inverting input terminal and an inverting input terminal, said non-inverting input terminal being connected to receive the output signal of said inverter means and said inverting input terminal being connected to receive said comparison output signal; and a capacitor, connected across the inverting input terminal and the output terminal of said amplifier.

7. An air-to-fuel ratio control system according to claim 6 further comprising:

a temperature detector, adapted to detect the temperature of said engine, for producing a detection signal while the temperature of said engine is lower than a predetermined temperature; and a hold circuit, connected to said temperature detector and said integration circuit, for holding said level of said integration output signal at a predetermined constant level irrespective of the level change of said comparison output signal while said detection signal is produced, whereby correcting the air-to-fuel ratio of mixture is prevented.

8. An air-to-fuel ratio control system according to claim 7, wherein said hold circuit includes:

comparator means for comparing said signal level of said integration output signal with said predetermined constant level at which said integration output signal is held; and switching means, adapted to be switched to a first switch condition while said detection signal is not generated and to a second switch condition while said detection signal is generated, for applying said comparison output signal to said integration circuit during said first switch condition and applying the output signal of said comparator means to said integration circuit during said second switch condition, whereby said integration circuit keeps changing said signal level of said integration output signal to said predetermined constant level while said switching means is switched to said second switch position.

9. An air-to-fuel ratio control system according to claim 8, wherein said mixture supply means includes a fuel injection device adapted to control fuel supply amount by a pulse signal which is corrected in accordance with said integration output signal, and wherein said integration circuit is adapted to control the integrating operation thereof in accordance with said pulse signal.

10. An air-to-fuel ratio control system according to claim 1, wherein said comparison circuit includes delay means for delaying said comparison output signal such that durations of one and the other between said two constant levels of said comparison output signal are increased and decreased by a predetermined constant time interval, respectively, whereby the air-to-fuel ratio of mixture to be supplied to said engine is corrected to the one other than said desired ratio.

* * * * *